US005683754A

United States Patent [19]

Tokuda et al.

[11] Patent Number: 5,683,754

[45] Date of Patent: Nov. 4, 1997

[54] PROCESS FOR FORMING COATING ON RUNNING FILM AND APPARATUS THEREFOR

[75] Inventors: Hiroshi Tokuda; Shinji Numazawa, both of Sagamihara, Japan

[73] Assignee: Teijin Limited, Osaka, Japan

[21] Appl. No.: 521,030

[22] Filed: Aug. 29, 1995

[30] Foreign Application Priority Data

Aug. 31, 1994 [JP] Japan ..... 6-206763

[51] Int. Cl.[6] ..... B05D 1/28

[52] U.S. Cl. ..... 427/428; 427/9; 427/355; 427/359; 427/434.2

[58] Field of Search ..... 427/9, 434.2, 428, 427/355, 359; 118/419, 413, 407, 110, 118, 123

[56] References Cited

U.S. PATENT DOCUMENTS 2,676,563 4/1954 Montgomery et al. ..... 118/252

FOREIGN PATENT DOCUMENTS 2237556 2/1973 Germany .
60-07725 1/1994 Japan .

*Primary Examiner*—Shrive Beck
*Assistant Examiner*—David M. Maiorana
*Attorney, Agent, or Firm*—Sherman and Shalloway

[57] ABSTRACT

A process for forming a coating having a constant thickness on at least one surface of a running film, which comprises continuously providing at least one surface of a running film with a first coating liquid film having a thickness greater than an intended thickness, transferring the first coating liquid film onto a roll which is in contact with the running film and rotates in the direction counter to the running direction of the running film, changing the first coating liquid film into a second coating liquid film having an intended constant thickness with a metering means, on the roll which rotates in the counter direction, and then transferring the second coating liquid film having the constant thickness onto the running film; and an apparatus therefor.

13 Claims, 2 Drawing Sheets

PROCESS FOR FORMING COATING ON RUNNING FILM AND APPARATUS THEREFOR

The present invention relates to a process for forming a coating having a constant thickness on a running film, and an apparatus therefor. More specifically, it relates to an application process for forming a uniform coating (layer) having an excellent appearance, which can be applied to high-speed off-line coating on a running film or high-speed in-line coating on a running film in a film-forming step, and an apparatus therefor.

Films or sheets such as plastic films are generally provided with coatings for imparting them with properties such as an adhesive property, lubricity, a gas-barrier property, humidity resistance and ink acceptability. As a coater used therefor, for example, a gravure coater, a kiss roll coater, a reverse roll coater and an extrusion die coater are known.

However, in the application methods using the above coaters, for example, an ordinary roll coater method has a defect in that a coating liquid is exposed to air and is liable to change in properties due to drying. In a die coater method, a coating liquid less exposed to air, while the responsiveness to changes and fluctuations in the tension level of a film to be coated is not adequate, so that the coating thickness is liable to vary. Further, it has a defect in that bare spots are liable to occur due to disturbances such as wrinkle. In the in-line coating in a film-forming step, in particular, stability is required for a long period of time, or over several days, and the tension cannot be definitely determined due to a change in the thickness of a formed film. The above prior art methods are not suitable for a step in which the tension level greatly changes. The prior art process for forming a coating will be explained more in detail below with reference to FIGS. 3 and 4. FIG. 4 illustrates a conventional roll coating method. FIG. 3 illustrates a well-known extrusion die coating method. In the continuous operation for a long period of time in the roll coating method shown in FIG. 4, after a coating liquid film 22 is transferred onto a running film 21, a roll surface a of an applicator roll 23 is liable to be dried to deposit scum-like solids thereon, so that not only the coating liquid film 22 but also a coating liquid film 22' transferred onto the film subsequently have defects. Further, the delivery of the coating liquid film is made between a pick up roll 25 and a gravure roll 26, and between the pick up roll 25 and the applicator roll 23, and bubbles are therefore likely to be formed in the coating liquid film in this delivery to cause defects on the coating liquid film. In high-speed application in particular, there is a problem in that the coating liquid film is liable to have a defect of streaks so that the productivity does not improve. In particular, in high-speed application using a coating liquid having a high viscosity, the coating liquid film is more liable to have such defect.

In a closed coater such as an extrusion die coater 27 shown in FIG. 3, the problem caused by exposure to air is minimal, while there is a defect in that the thickness (width) of a formed coating varies when the tension of a film 21 varies even if a coating liquid is fed in a constant amount. In a biaxial orienting step in particular, it is so difficult to maintain a constant tension due to a film thickness level that a coating liquid film 22' is liable to vary in thickness (width). Further, when a film is a thick-edged film, there is a problem in that wrinkles are liable to occur due to tension and that the wrinkles are liable to cause a defect on the coating liquid film in a die kiss touch method.

It is therefore an object of the present invention to provide a novel process for forming a coating having a constant thickness on a running film.

It is another object of the present invention to provide a novel process for forming a coating, in which a coating liquid film is formed on a running film. The coating liquid film is once transferred onto a rotating roll. The coating liquid film is adjusted to a constant thickness while it is positioned on the rotating roll, and then, the coating liquid film having the adjusted constant thickness is transferred onto the running film.

It is further another object of the present invention to provide a process for forming a coating in which a coating liquid film having a constant thickness can be formed on a running film even at a high speed regardless of a change in the tension of the running film, with avoiding the occurrence of wrinkles of the running film or the drying of a roll.

It is further another object of the present invention to provide a process for forming a coating, which can be applied to the in-line coating in a biaxial orienting step and can give a coating having an excellent appearance.

It is still further another object of the present invention to provide an apparatus for forming a coating, with which the above method of the present invention can be advantageously worked.

Other objects and advantages of the present invention will be apparent from the following description.

According to the present invention, the above objects and advantages of the present invention are achieved, first, by a process for forming a coating having a constant thickness on at least one surface of a running film, which comprises continuously providing at least one surface of a running film with a first coating liquid film having a thickness greater than an intended thickness, transferring the first coating liquid film onto a roll which is in contact with the running film and rotates in the direction counter to the running direction of the running film, changing the first coating liquid film into a second coating liquid film having an intended constant thickness with a metering means, on the roll which rotates in the counter direction, and then transferring the second coating liquid film having the constant thickness onto the running film.

Further, according to the present invention, the above process of the present invention can be industrially advantageously practiced by an apparatus for forming a coating having a constant thickness on at least one surface of a running film, which comprises a means of feeding a coating liquid onto a running film for continuously forming a first coating liquid film having a thickness greater than an intended thickness on the running film, a rotation roll which rotates in the direction counter to the running direction of the running film and receives, thereon, the first coating liquid film on the running film, and a metering means for changing the first coating liquid film into a second coating liquid film having the intended thickness on the rotation roll.

Figure 1:
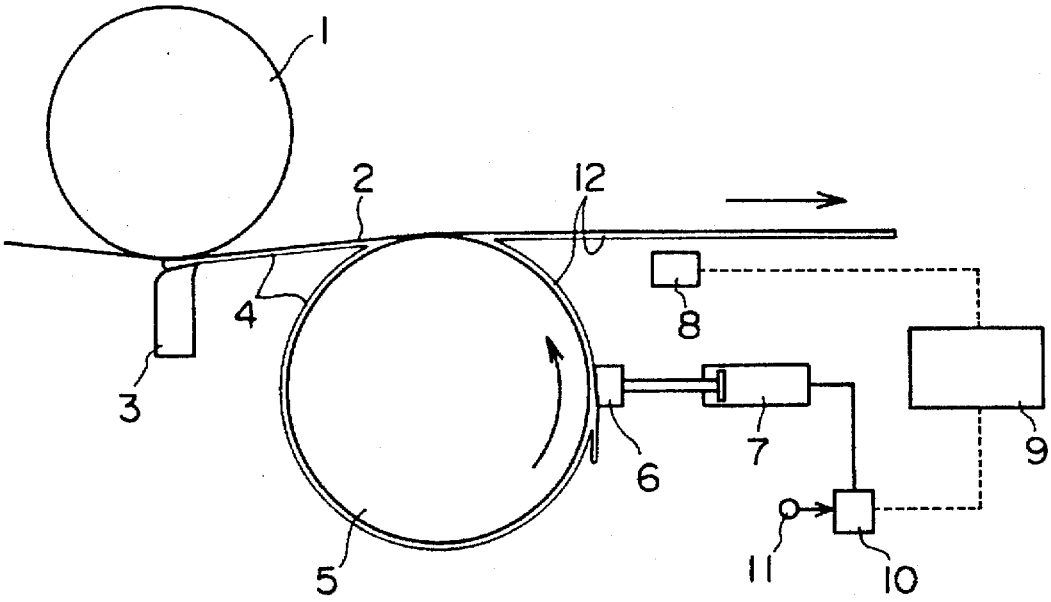
FIG. 1 is a schematic side view of an apparatus of the present invention suitable for working the process of the present invention.

The present invention will be explained hereinafter.

In the process of the present invention, in the first step, a coating liquid film having a thickness greater than an intended thickness is continuously formed on at least one surface of a running film. The "intended thickness" refers to the thickness of a coating liquid film to be finally formed on a film, i,e, a second coating liquid film to be described later.

The coating liquid feeding means for continuously forming the first coating liquid film on a running film includes, for example, the application of a coating liquid with a die coater including a fountain die coater, the application of a coating liquid with a sprayer, and the application by dipping a film in a coating liquid.

The thickness of the first coating liquid film is approximately 1.2 to 5 times as large as the intended thickness, i.e, the thickness of the second coating liquid film, while it is preferably approximately 1,5 to 2 times as large.

The running rate of the running film is preferably about 2 to about 1,500 m/minute, more preferably 10 to 300 m/minute.

The first coating liquid film is formed on at least one surface of the running film. When a first coating liquid film is formed on each surface of the running film, at least two coating liquid feeding means are required for providing each surface with the coating liquid.

The film may be formed of any material, and the material includes, for example, aromatic polyesters such as polyethylene terephthalate and polyethylene-2,6-naphthalenedicarboxylate, and polyolefins such as polyethylene and polypropylene.

When the first coating liquid film is formed on the running film, preferably, a guide roll for the running film is provided in the upstream of the running film relative to the above rotating roll (rotation roll), and the running film is tensioned between the guide roll and the rotation roll. In this manner, the occurrence of wrinkles of the running film can be prevented as well.

In the subsequent second step in the process of the present invention, the first coating liquid film which has been continuously formed on the running film in the first step is transferred onto a roll which is in contact with the running film and rotates in the direction counter to the running direction of the running film.

The above rotation roll therefore receives the first coating liquid film from the running film onto its roll surface.

The running film is in contact with the rotation roll, preferably, in a state in which the contact angle of the running film to the rotation roll is in the range of from 1 to 10 degrees.

The running film is not necessarily required to run at a rate equivalent to the peripheral speed of the rotation roll. For example, the running film may run at a rate approximately 0.67 to 2 times as high as the peripheral speed of the rotation roll.

For smoothly transferring the first coating liquid film formed on the running film onto the rotation roll, preferably, the first coating liquid film is transferred onto the rotation roll in the vicinity of a contact point of the running film and the rotation roll.

In the third step in the process of the present invention, the first coating liquid film is changed into a second coating liquid film having an intended constant thickness with a metering means, on the rotation roll.

Although not specially limited, the metering means is preferably selected from a doctor knife, a wire bar, a gravure roll and a roll which rotates in the direction counter to the rotation roll and is out of contact with the rotation roll (gapped reverse roll method).

The above metering means is preferably placed at an angle in the range of from about 80 to 100 degrees apart in the rotation direction of the rotation roll from the gravity direction.

As a metering means, a doctor knife is particularly preferred.

The doctor knife as a metering means preferably has a surface which contacts the coating liquid or the coating 11quid film on the rotation roll and forms a surface which generates buoyancy due to the coating liquid. Further, the surface which contacts the Coating liquid on the rotation roll more preferably forms such a surface that the path for the coating liquid narrows toward downstream of the rotation roll.

Further, when the doctor knife forms the above surface, preferably, the doctor knife is connected with means capable of imparting the doctor knife with a force fully resistant to the buoyancy due to the coating liquid. The above is for preventing the displacement or subtle movement of the doctor knife caused by the buoyancy.

When the surface of the doctor knife which contacts the coating liquid on the rotation roll is flexible and when the above surface is connected with a plurality of means which are capable of imparting the doctor knife with a force fully resistant to the buoyancy due to the coating liquid and arranged in the width direction of the coating liquid application, the second coating liquid film having a constant thickness in the width direction of the coating liquid film can be formed by independently actuating a plurality of the means depending upon the surface form of the rotation roll.

As another means, a constant thickness of the second coating liquid film may be attained by measuring the second coating liquid film on the running film for a thickness and, if the obtained thickness is different from the predetermined thickness, automatically controlling the pressure to be exerted on the doctor knife and/or the amount of the coating liquid to be fed onto the running film surface such that the second coating liquid film has a predetermined thickness.

In the fourth step In the process of the present invention, the second coating liquid film having a constant thickness, formed on the rotation roll in the third step, is retransferred onto the running film, i.e., the running film from which the first coating liquid film has been transferred onto the rotation roll.

The second coating liquid film preferably is retransferred onto the running film in the vicinity of a contact point of the running film and the rotation roll.

The present invention will be explained more in detail hereinafter with reference to drawings.

FIG. 1 shows one embodiment of the present invention, in which 1 indicates a guide roll, 2 indicates a running film, 3 indicates a fountain die, 4 indicates a precoating (first coating liquid film), 5 indicates an applicator roll (rotation roll), 6 indicates a doctor knife, 7 indicates an air cylinder, 8 indicates a thickness meter, 9 indicates a controller, 10 indicates an electric-pneumatic converter, 11 indicates a pressurized air source, and 12 indicates a second coating liquid film.

Figure 2:
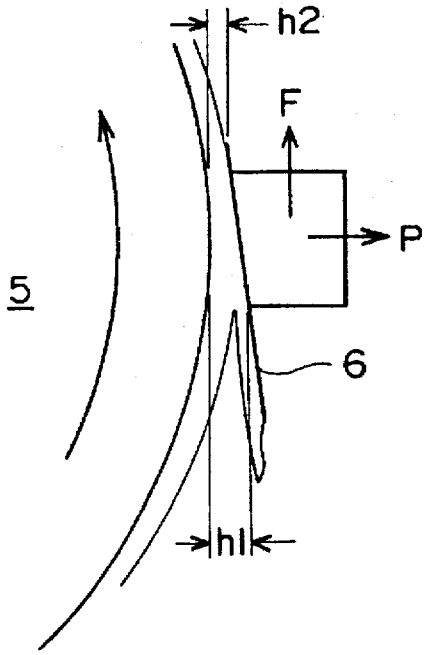
FIG. 2 is a partially enlarged side view of the apparatus shown in FIG. 1.

A coating liquid in an amount slightly larger than a required amount is applied onto the running film 2 with the fountain die 3 to form the precoating (first coating liquid film) 4. The thickness of the precoating 4 slightly varies depending upon the fluctuation of tension of the film 2. Then, the first coating liquid film 4 is once peeled and transferred onto the applicator roll 5 by reverse-rotating the applicator roll 5 in the counter direction to the running direction of the running film 2. Due to the applicator roll 5 and the guide roll 1 positioned in a preceding place, the occurrence of wrinkles in the film is prevented and the film is tensioned, so that a relatively good film-like coating liquid (coating) is obtained with the fountain die 3. The first coating liquid film transferred onto the applicator roll is measured, and adjusted to a constant thickness with the doctor knife 6, and at the same time, it is also uniformly leveled in the coating liquid thickness distribution in the width direction to form the second coating liquid film. Then, the second coating liquid film is transferred onto the film 2. As shown in the partially enlarged side view of FIG. 2, the top portion of the doctor knife 6 is provided with a slope which narrows a coating liquid path toward the rotation direction of the roll 5 and which satisfies the relationship of $h1>h2$. The gap h2 of the final outlet determines the thickness of the coating liquid. h1 is preferably in the range of $1.4\times h2$ to $4.2\times h2$. When the buoyancy P of the doctor knife 6 to be described later is to increased, h1 is preferably approximately $2.2\times h2$. When the coating liquid flows on the top of the doctor knife 6, the narrowing activity generates a reaction force P (buoyancy) in the normal direction and a reaction force F (flow frictional force) in the tangent direction. One of the features of the present invention is that the doctor knife 6 is supported under pressure with the air cylinder 7, particularly a low-friction air cylinder, so as to be movable in the normal direction (P direction) to balance the reaction force P. In this case, a reaction force F, which is very slight, is generated in the tangent direction (F direction), but the doctor knife 6 is supported so as not to be displaced. Although the applicator roll 5 is highly accurately produced, it has a roundness deflection of several μm to tens μm due to the limitation of processing accuracy. If the doctor knife 6 is completely fixed the coating liquid film has thickness nonuniformity (fluctuation) due to the roundness deflection. This fluctuation can be overcome since the constant gap h2 can be maintained and adjusted by the above method of movably supporting the doctor knife under pressure even if the roundness of the roll 5 deflects. When h2 is positively changed, i.e., when the level of the thickness of the coating liquid film is changed, this change can be accomplished by changing the loading pressure on the doctor knife 6. In this connection, the loading pressure is increased for decreasing the thickness of the coating liquid film, and decreased for increasing the thickness of the coating liquid film. That is, the pressure to be applied to the cylinder 7 and the thickness of the coating liquid film are univocally correlated so that the thickness of the coating liquid film can be controlled with the pressure on the doctor knife 6 as required. Other preferred feature of the present invention is as follows. The thickness of the final second coating liquid film which is transferred onto the running film 2 with the applicator roll 5 is detected with the thickness meter 8, and the electric-pneumatic converter (air pressure regulator) 10 is controlled by actuating the controller 9 on the basis of a deviation from an intended thickness, to adjust pressurized air from the air source 11 and feed it to the cylinder 7, so that the thickness of the coating liquid film is adjusted to a constant value. The above cylinder 7 is preferably a cylinder of which the actuation resistance is small, such as a bellows diaphragm cylinder or a non-seal cylinder. The electric-pneumatic converter 10 is preferably a precision electric-pneumatic converter. The thickness meter 8 can be selected from various non-contact type thickness meters such as an infrared thickness meter, an optical interference thickness meter, a dielectric type thickness meter and a microwave absorption thickness meter. FIG. 1 shows only the side view of one embodiment of the present invention. The roundness of the applicator roll 5 varies in the width direction in many cases, and for absorbing the roll deflection in the width direction, therefore, the doctor knife 6 is preferably structured in the width direction so as to have free flexibility in the P direction. It is accordingly preferred to arrange a plurality of cylinders 7 in the width direction. As a result, the deflection of the applicator roll 5 in the width direction is absorbed with the flexibility of the doctor knife 6, so that the coating liquid film having a constant thickness in any position can be formed. The defect caused by drying under the exposure to air, which a roll coater inherently has, can be overcome by the present invention in which the applicator roll 5 is always covered with a fresh coating liquid on the entire circumference of the applicator roll 5, and the fresh coating liquid is constantly renewed.

Figure 5:
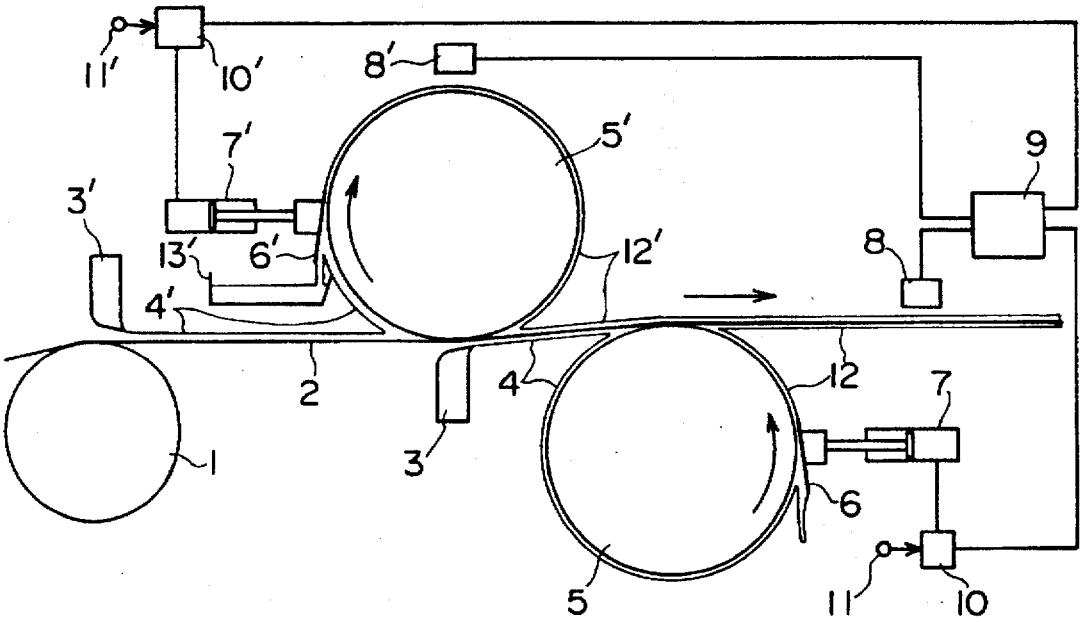
FIG. 5 is a schematic side view of another embodiment of the apparatus of the present invention suitable for working the process of the present invention.

FIG. 5 shows another embodiment of the present invention. In FIG. 5, 1' to 12' have the same meanings as those corresponding to 1 to 12 in FIGS. 1 and 2. That is, FIG. 5 shows an apparatus for forming coating liquid films having a constant thickness, one on one surface of a running film 2 and the other on the other surface.

The process for forming a coating liquid film having a constant thickness on the lower surface of the running film 2 can be fully understood on the basis of the explanations of the apparatus shown in FIG. 1. On the other hand, for forming a coating liquid film 12' having a constant thickness on the upper surface of the running film 2, the coating liquid in an amount slightly larger than a required amount is fed on the upper surface of running film 2 from a fountain die 3' to form a precoating 4', the precoating 4' is transferred onto an applicator roll 5' which rotates in the counter direction to the running film of the running film and then adjusted to a coating liquid film 12' having a constant thickness with a doctor knife 6', and then the coating liquid film is retransferred onto the upper surface of the running film. In FIG. 5, the leftover coating liquid after the measurement with the doctor knife 6' is collected into a receiver 13' as shown in FIG. 5 so that no coating liquid drops on the running film.

In FIG. 5, the applicator roll 5 is positioned in the forward position to the applicator roll 5' in the running direction of the running film, while the positional relationship of these applicator rolls may be reverse.

The present invention will be explained hereinafter with reference to Examples.

EXAMPLE 1

The apparatus shown in FIG. 1 was used. While a film having a thickness of 100 μm was allowed to run at a rate of 50 m/minute, a water-based emulsion type coating liquid having a viscosity of 10 cp was applied with a fountain die 3 to form a coating liquid film having a thickness of a little larger than 4 μm. Then, the formed coating liquid film (precoating) was peeled off and transferred onto an applicator roll 5 which was reversely rotated, and adjusted to a thickness of 4 μm by automatically controlling a pressure on a doctor knife 6. Then, the adjusted coating liquid film was retransferred onto the running film. In this case, the final coating liquid film was measured for a thickness with an optical interference thickness meter (Otsuka Electronics Co., Ltd) to adjust the thickness into 4 μm. When the surface speed of the reversely rotating applicator roll 5 was in the range of 30 to 60 m/minute, the application of the coating liquid was stabilized, and an excellent coating was obtained.

EXAMPLE 2

Example 1 was repeated except that the water-based emulsion type coating liquid was replaced with a water-based emulsion type coating liquid having a viscosity of 3 cp, that the film was replaced with a film having a thickness of 50 μm, that the running rate of the film was changed to 100 m/minute, and further that the pressure on the doctor knife was automatically controlled to form a final coating liquid film having a thickness of 2 μm. When the surface speed of the reversely rotating applicator roll 5 was in the range of 60 to 120 m/minute the application of the coating liquid was stabilized, and an excellent coating was obtained.

COMPARATIVE EXAMPLE 1

Figure 3:
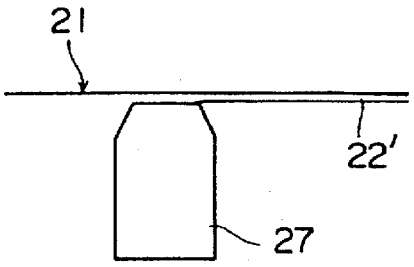
Fig. 3 PRIOR ART
FIG. 3 is a schematic side view of one prior art die coater.

The same coating liquid as that used in Example 1 was applied to a film having the same film thickness as that used in Example 1 with a die coater shown in FIG. 3 at the same film running rate as that in Example 1. Due to wrinkles which sometimes occurred, the film partly floated from the die, and the defect of bare spots occurred.

COMPARATIVE EXAMPLE 2

Figure 4:
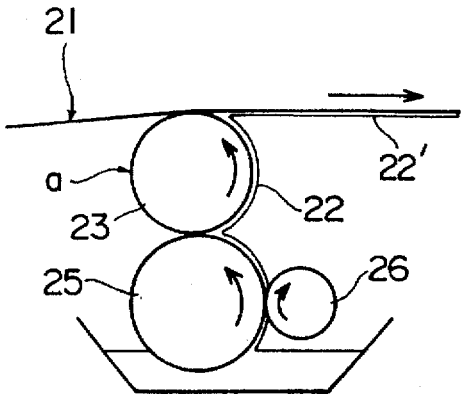
Fig. 4 PRIOR ART
FIG. 4 is a schematic side view of one prior art offset gravure coater.

Comparative Example 1 was repeated except that the die coater was replaced with an offset gravure coater shown in FIG. 4. As a result, there was no defect of bare spots caused by wrinkles which would sometimes occur on the running film, while the application defect of streaks in the film length direction occurred on the film.

COMPARATIVE EXAMPLE 3

While Comparative Example 1 was repeated except that the die coater was replaced with an offset gravure coater shown in FIG. 4, an attempt was made to seek for conditions under which the application defect of streaks in the film length direction in Comparative Example 2 did not occur. When the film running rate was decreased to 25 m/minute, a coating nearly equivalent to the coating in Example 1 was formed. However, under these conditions, the application rate was greatly low, and the productivity was very poor.

As explained above, according to the present invention, there can be provided an application process and an apparatus therefor, which accomplish the following. A coating having almost no bare spots as compared with coatings obtained by prior art methods can be obtained, and the process is stable against disturbances such as a wrinkle of a film, When coating liquids having different viscosities are used, or when the application conditions are greatly changed, the process is free from causing thickness nonuniformity, the application can be excellently made at a high speed, and a coating having a high quality can be obtained. The process can therefore serves to greatly improve the productivity.

What is claimed is:

1. A process for forming a coating having a constant thickness on at least one surface of a running film, which comprises continuously providing at least one surface of a running film with a first coating liquid film having a thickness greater than an intended thickness, transferring the first coating liquid film onto a roll which is in contact with the running film and rotates in the direction counter to the running direction of the running film, changing the first coating liquid film into a second coating liquid film having an intended constant thickness with a metering means on the roll, said metering means being a doctor knife spaced apart from the roll by a distance equal to the intended constant thickness, said doctor knife having a surface which contacts the coating liquid on the roll, said contact of said coating liquid and said surface generating a force on said doctor knife, said force on said doctor knife having a component normal to the surface of the roll, and then transferring the second coating liquid film having the constant thickness onto the running film.

2. The process of claim 1, wherein the first coating liquid film is formed by application with a die coater, application with a sprayer or application by dipping the film in the coating liquid.

3. The process of claim 1, wherein the first coating liquid film is formed to have a thickness which is approximately 1.2 to 5 times as large as the intended thickness.

4. The process of claim 1, wherein the film is allowed to run at a rate of about 2 to about 1,500 m/minute.

5. The process of claim 1, wherein the roll is rotated at a peripheral speed which is 0.5 to 1.5 times as large as the running rate of the running film.

6. The process of claim 1, wherein the running film has a contact angle to the roll in the range of from 1 to 10 degrees.

7. The process of claim 1, wherein the first coating liquid film on the running film is transferred onto the roll at a contact point of the running film and the rotation roll.

8. The process of claim 1, wherein the metering means is placement an angle in the range of from about 80 to 100 degrees apart in the rotation direction of the roll from the bottom of the roll.

9. The process of claim 1, wherein the second coating liquid film on the roll is transferred onto the running film at a contact point of the running film and the roll.

10. The process of claim 1, wherein the doctor knife has a surface which contacts the coating liquid on the roll and forms a surface which narrows a path for the coating liquid toward downstream of the rotation of the roll.

11. The process of claim 1, wherein the doctor knife is supported by a means capable of imparting a force to the doctor knife resistant to the force on the doctor knife generated due to the contact of the doctor knife with the coating liquid.

12. The process of claim 1, wherein the doctor knife has a surface which contacts the coating liquid on the roll and said surface is flexible, said surface being supported by a plurality of support means capable of imparting a force to the doctor knife resistant to the force on the doctor knife generated due to the contact of the doctor knife with the coating liquid and arranged in the width direction of the coating liquid application, and the second coating liquid film is imparted with a constant thickness in the width direction of the coating liquid application by independently actuating said support means depending upon a surface from of the roll.

13. The process of claim 1, wherein the second coating liquid film on the running film is measured for a thickness and, if the obtained thickness is different from a predetermined thickness, the pressure to be exerted on the doctor knife and/or the amount of the coating liquid to be fed onto the running film is/are automatically controlled to form the second coating liquid film having the predetermined thickness.

* * * * *